United States Patent [19]

Altherr

[11] 4,376,488

[45] Mar. 15, 1983

[54] RAILWAY COUPLER CARRIER ASSEMBLY

[75] Inventor: Russell G. Altherr, Munster, Ind.

[73] Assignee: Amsted Industries Incorporated, Chicago, Ill.

[21] Appl. No.: 185,212

[22] Filed: Sep. 8, 1980

Related U.S. Application Data

[63] Continuation of Ser. No. 53,345, Jun. 29, 1979, abandoned.

[51] Int. Cl.[3] ..... B61G 9/22; B61G 7/10

[52] U.S. Cl. ..... 213/61

[58] Field of Search ..... 213/20, 21, 60, 61, 213/62 R, 62 A; 308/4 R, 70, 237 R

[56] References Cited

U.S. PATENT DOCUMENTS 3,669,518 6/1972 Kohler ..... 308/237 R 4,105,128 8/1978 Spencer ..... 213/61

*Primary Examiner*—Randolph A. Reese

*Attorney, Agent, or Firm*—Edward J. Brosius; Fred P. Kostka; John L. Schmitt

[57] ABSTRACT

An improved coupler carrier assembly comprises a spring basket, having front, rear, end and bottom walls, with a plurality of compression springs disposed therein; a coupler carrier having a lower portion disposed in the spring basket and being supported on the compression springs for vertical movement in the basket; and a wear element defined by a front wall, a rear wall and a bottom wall and located so that the front, rear and bottom walls are adjacent to at least a portion of the inside surfaces of the front, rear and bottom walls of the spring basket, respectively. Reduced wear between the spring basket and the coupler carrier is obtained.

2 Claims, 8 Drawing Figures

RAILWAY COUPLER CARRIER ASSEMBLY

This is a continuation of application Ser. No. 53,345, filed June 29, 1979 now abandoned.

BACKGROUND AND SUMMARY OF THE INVENTION

The invention relates to an improved coupler carrier assembly. More particularly, the invention relates to such assemblies which involve couplers that angle vertically with respect to the railway car to negotiate vertical curves.

Railway car couplers that are required to angle vertically with respect to the car, e.g., in order for the car to negotiate vertical curves, are often resiliently supported by springs that are partially compressed to a height that holds the coupler shank substantially horizontal. See U.S. Pat. Nos. 2,680,526 and 2,899,083. One disadvantage of such systems is the amount of wear which occurs between the contacting surfaces of the spring basket (which carries the springs) and the coupler carrier as the basket and carrier move relative to each other.

U.S. Pat. No. 4,105,128 discloses a carrier coupler assembly in which wear plates are interposed between the surfaces of the basket and the coupler carrier to reduce the wear noted above. However, the system of U.S. Pat. No. 4,105,128 requires that the wear plate be secured by welding. It is desired to produce a wear plate that can be secured within the basket without welding, and accordingly easily removed for replacement.

Accordingly, it is an object of this invention to provide an improved coupler carrier assembly which exhibits improved wear resistance.

An improved railway coupler carrier assembly has now been discovered. This assembly is of the type which includes a spring basket defined by front and rear, preferably substantially vertical, walls, two substantially opposing end walls and a bottom wall. The spring basket acts as a carrier pocket with a plurality of, e.g., three (3) springs disposed therein. A coupler carrier, having an upper substantially horizontal plate portion for supporting a coupler, has a lower portion at least partially disposed in the spring basket. This coupler carrier, including the lower portion, having front and rear walls, preferably substantially vertical front and rear walls, is supported on the compression springs for vertical movement in the spring basket.

The present improvement involves a wear element defined by a front wall, a rear wall and a bottom wall. This wear element is located so that the front, rear and bottom walls of the wear element are adjacent to, preferably in contact with, at least a portion of the inner surfaces of the front, rear and bottom walls of the spring basket, respectively. The wear element acts to reduce contact between the spring basket and the coupler carrier as the basket and carrier e.g., lower portion thereof, move in relation to each other.

Other preferred embodiments will be illustrated hereinafter. However, the present assembly clearly provides improved wear resistance for the relative movement of spring basket and coupler carrier. In addition, the walls of the spring basket do not require special machining or shoulders to properly locate or retain the wear element. The unitized nature of the present wear element, with the front, rear and bottom walls acting as a unit, provides substantial advantages. For example, the wear element remains securely in its place more reliably than the prior art wear plates. In addition, in a preferred embodiment, at least one, and more preferably all, of the compression springs rest on the bottom wall of the wear element to further secure the element in place during use.

These and other aspects and advantages of the present invention are set forth in the following detailed description and claims, particularly when considered in conjunction with the accompanying drawings in which like parts bear like reference numerals.

DESCRIPTION OF THE PREFERRED EMBODIMENT

Figure 1:
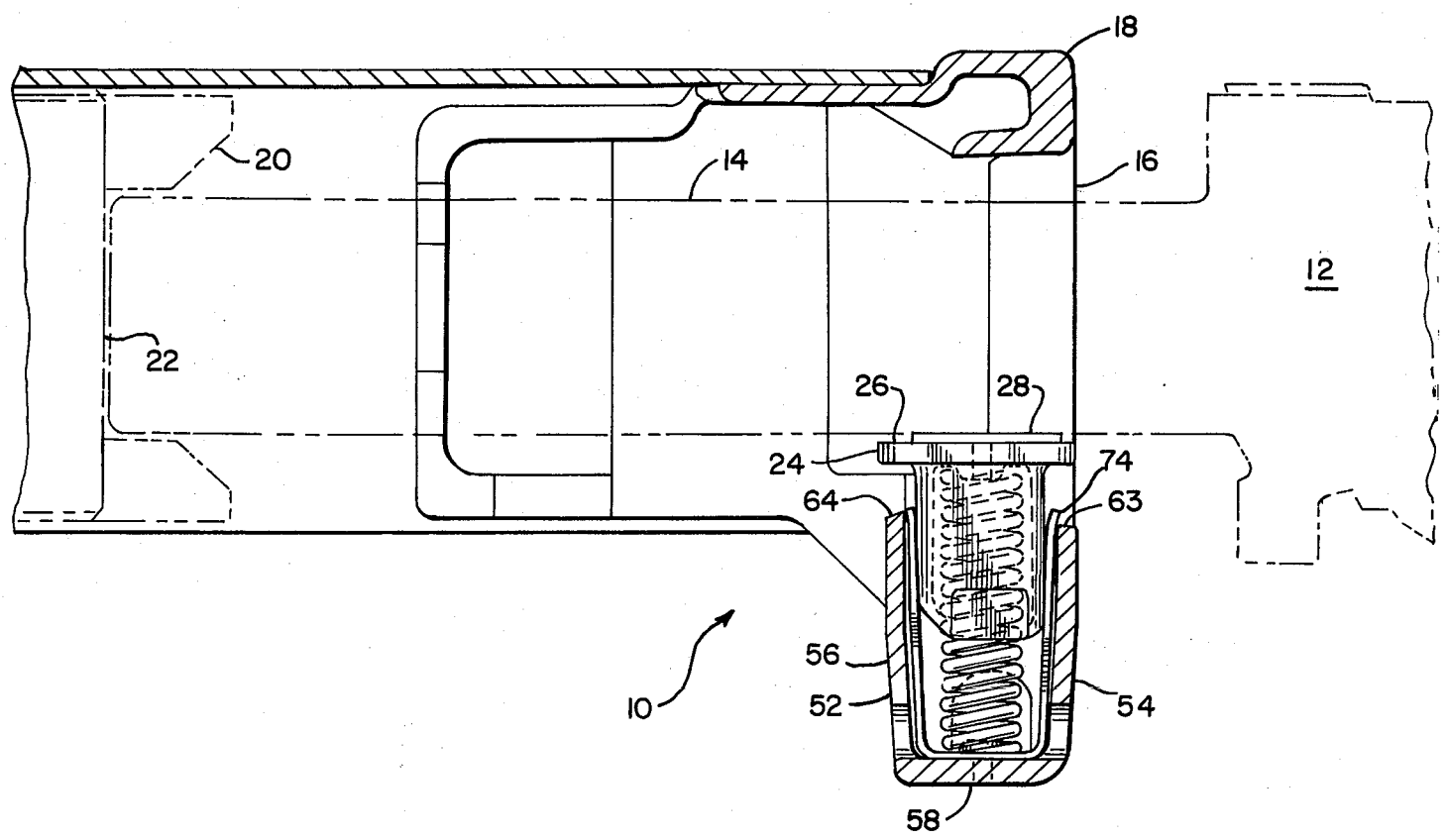
FIG. 1 is a side elevational view, partly in cross section, of the striker assembly of a railway car coupler mechanism, showing the coupler shank in shadow lines.

Referring now to FIG. 1 of the drawings, a railway coupler striker assembly is shown generally at 10. Coupler 12 is shown with shank 14 projecting through the front opening 16 of striker assembly 18 and is connected to yoke 20 by pin 22. Shank 14 is supported by coupler carrier 24.

Figure 3:
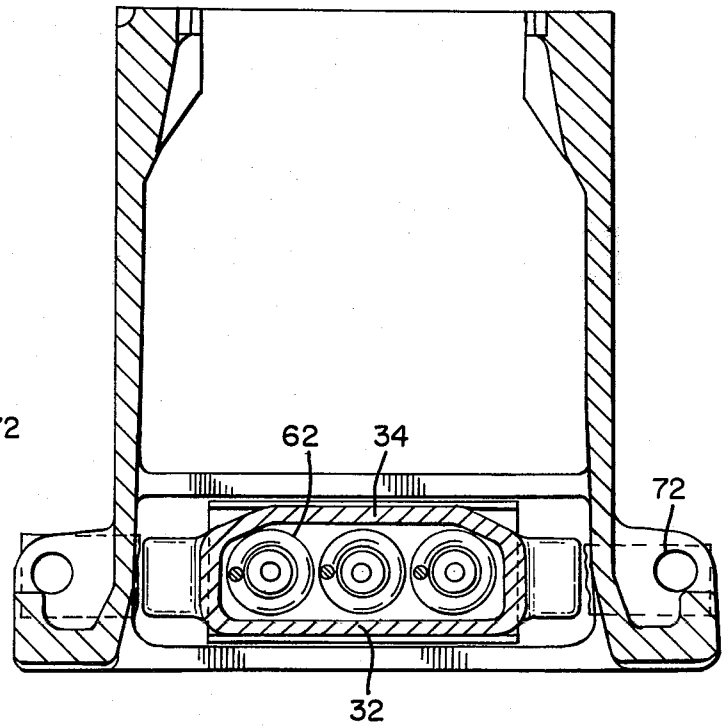
FIG. 3 is a top sectional view, in cross section, of a first embodiment of the striker assembly shown in FIG. 1.
Figure 2:
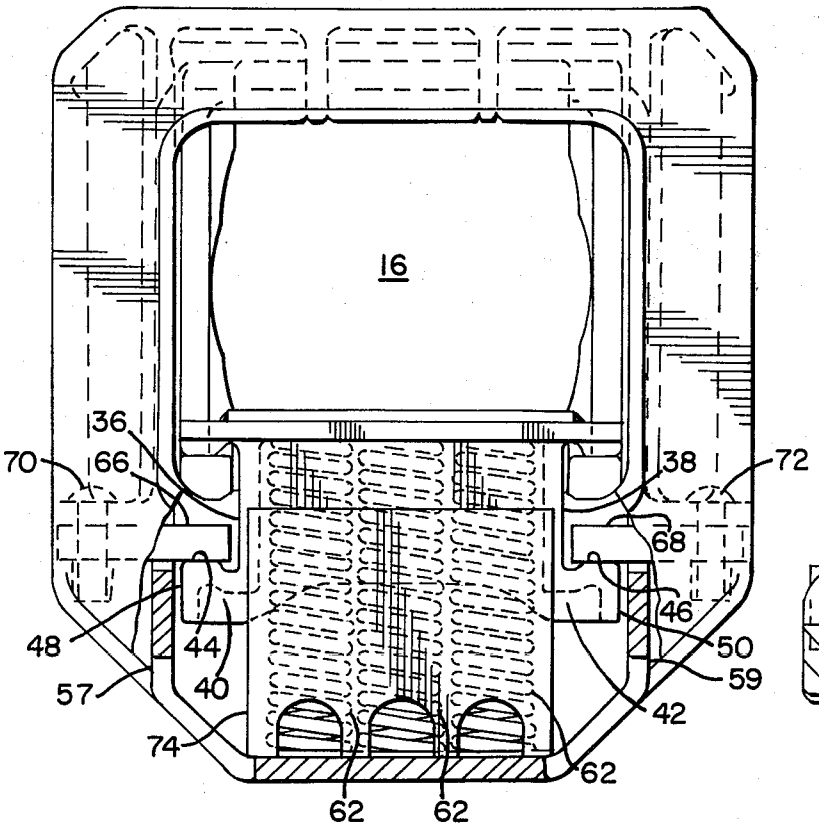
FIG. 2 is a front elevational view, partly in cross section, of a first embodiment of the striker assembly shown in FIG. 1.
Figure 5:
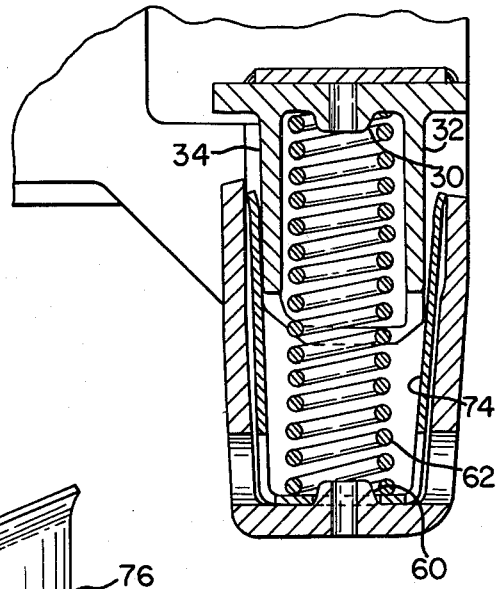
FIG. 5 is a close-up, side elevational view, in cross section, of part of the striker assembly shown in FIG. 1.

Coupler carrier 24 has a top wall 26 to which a carrier wear plate 28 is attached for sliding engagement with shank 14. Preferably, shank 14 is equipped with a wear plate (not shown) which contacts carrier wear plate 28 thereby reducing wear on both the shank 14 and coupler carrier 24. As seen in FIGS. 2, 3 and 5, projecting downward from top wall 26 of coupler carrier 24 are three upper bosses 30, front carrier wall 32, rear carrier wall 34, and end carrier walls 36 and 38. At the lower end of each end carrier wall 36 and 38 is a laterally projecting lug 40 and 42, respectively. Lugs 40 and 42 have top surfaces 44 and 46, and vertical end surfaces 48 and 50, respectively.

Striker assembly 18 is formed so as to include a spring basket 52 which has a front basket wall 54, a rear basket wall 56, end basket walls 57 and 59 and a bottom basket wall 58. As can be seen in the figures, front basket wall 54, rear basket wall 56, end basket walls 57 and 59 and bottom basket wall 58 are connected to form spring basket 52. Bottom basket wall 58 has upwardly projecting lower bosses 60 each of which is substantially aligned with a different upper boss 30. Three compression springs 62 are each positioned between a different upper boss 30 and lower boss 60.

Coupler carrier 24 is supported on springs 62 and at least portions of front carrier wall 32, rear carrier wall 34, end carrier walls 36 and 38 and lugs 40 and 42 telescope into spring basket 52. Coupler carrier 24 is guided for vertical movement by the corresponding and cooperating structure of front and rear carrier walls 32 and 34 and vertical surfaces 48 and 50 with front and rear basket walls 54 and 56 and basket walls 57 and 59, respectively. Carrier 24 is limited in downward movement by contact of top wall 26 with the top surfaces 63 and 64 of front and rear basket walls 54 and 56, respectively.

The assembled height of coupler carrier 24 is established in prior art assemblies and in one embodiment by retainer blocks 66 and 68 which project over lugs 40 and 42, respectively, through holes in basket end walls 57 and 59 and are secured to striker assembly 18 by rivets 70 and 72.

Figure 4:
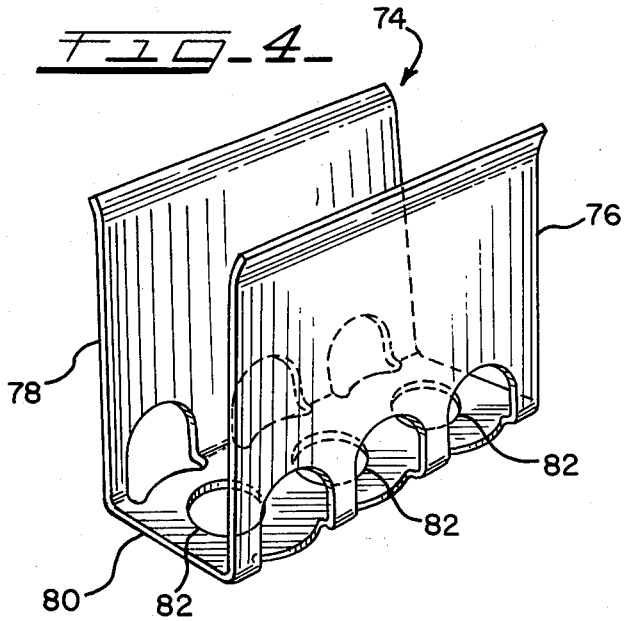
FIG. 4 is a front-side plan view, in perspective, of a first embodiment of a wear element.

A first embodiment of wear element 74 is shown in FIG. 4. Wear element 74 is disposed between the moving components of the spring basket 52 and the coupler carrier 24 to reduce wear caused by such relative movement. Wear element 74 has a front wear wall 76 and a rear wear wall 78 each of which is connected to a spring seat 80 which has holes 82 arranged to fit over lower bosses 60. Front and rear wear walls 76 and 78 are structured to accept front and rear carrier walls 32 and 34 and fit between front and rear basket walls 54 and 56 respectively. The top portions 84 and 86 of front and rear wear walls 76 and 78 diverge slightly from each other to further reduce wear caused by contact of wear element 74 with coupler carrier 24.

Wear element 74 is a one piece wear plate designed, for example, to protect front and rear basket walls 54 and 56, and is secured from vertical movement by bottom basket wall 58 and the vertical pressure of springs 62. Wear element 74 is secured from horizontal movement by lower bosses 60. Wear element 74 does not require any special machining or other preparation of front and rear basket walls 54 and 56 since it is secured in place as noted above.

Figure 6:
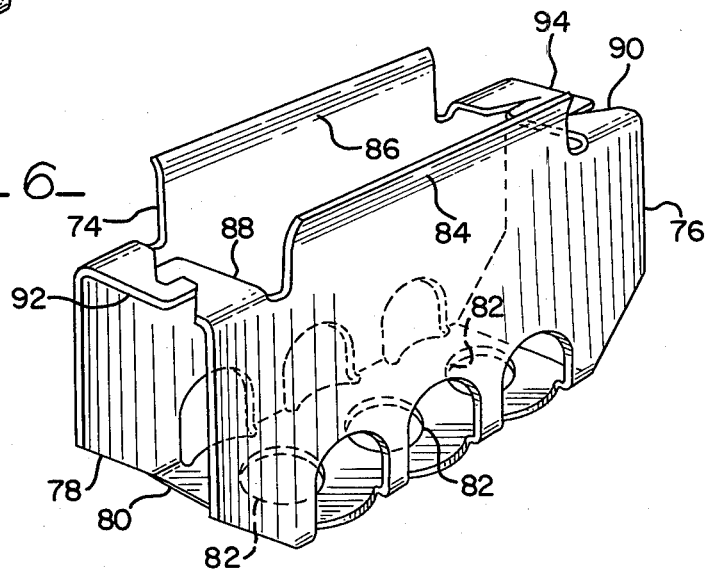
FIG. 6 is a front-side plan view, in perspective, of a second embodiment of a wear element.
Figure 8:
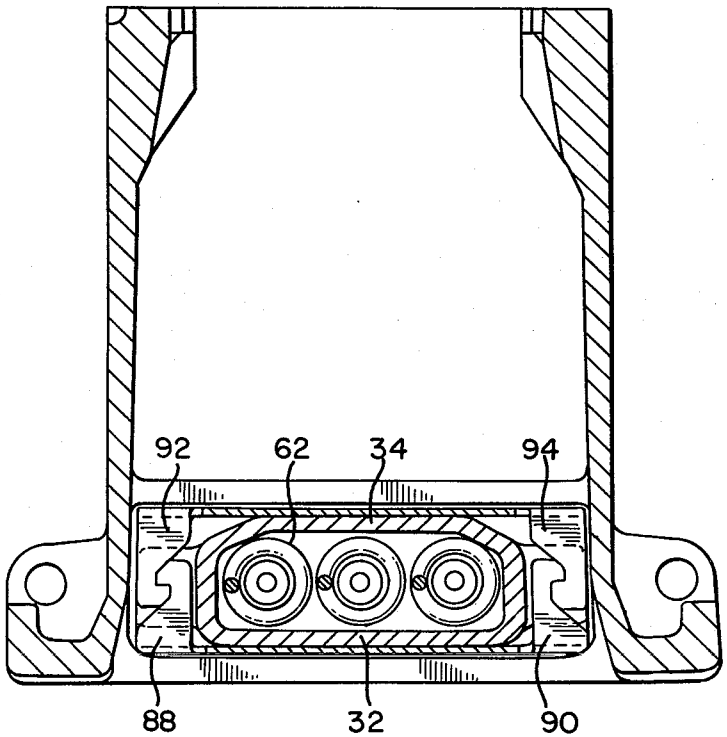
FIG. 8 is a top sectional view, in cross section, of a second embodiment of the striker assembly.
Figure 7:
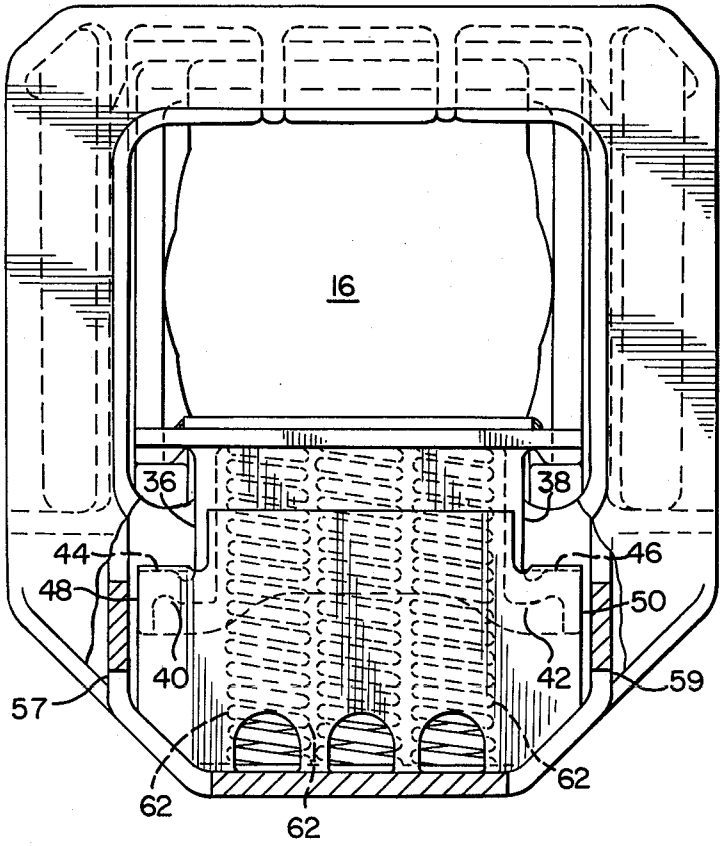
FIG. 7 is a front elevational view, partly in cross section, of a second embodiment of the striker assembly.

In another embodiment, shown in FIGS. 6, 7 and 8, wear element 74 has rearwardly projecting tabs 88 and 90 extending from each end of front wear wall 76 and forwardly projecting tabs 92 and 94 extending from each end of rear wear wall 78. These tabs 88, 90, 92 and 94 are configured so that tabs 88 and 92 can be interlocked or engaged and tabs 90 and 94 can be interlocked or engaged. The two sets of interlocked tabs 88, 92 and 90, 94 are welded together to assure that the interlocks do not separate. In an alternate embodiment, the respective tabs can be projected from the edges of walls 76 and 78. After placement of coupler carrier 24 on springs 62 a compressive force is applied to the top carrier wall 26 and spring seat 80, until the height of the system allows the interlocked tabs 88, 92, and 90, 94 to be positioned over lugs 40 and 42, respectively. In this embodiment, the height of interlocked tabs 88, 92, and 90, 94 will determine the carrier height upon first assembly in the spring basket 52. Thus, retainer blocks 66 and 68 are not necessary in this embodiment of the present invention. Other elements shown in FIGS. 7 and 8 correspond with identically numbered elements in FIGS. 2 and 3.

With the assembled striker 18 containing coupler carrier 24 attached to a railway car, the shank 14 of coupler 12 is placed through the front opening 16 and attached to yoke 20 with pin 22. When coupler 12 angles downward, coupler carrier 24 telescopes downward between front and rear walls 76 and 78 to prevent wear of front and rear basket walls 54 and 56, respectively. When the coupler 12 returns to normal position or is angled upward, springs 62 expand to raise coupler carrier 24 until lugs 40 and 42 are restrained from further vertical motion, e.g., by engaging interlocked tabs 88, 92 and 90, 94, respectively or by engaging retainer blocks 66 and 68. In any event, the present invention provides effective, reliable and relatively maintenance free wear protection for both spring basket 56 and coupler carrier 24.

While this invention has been described with respect to various specific examples and embodiments, it is to be understood that the invention is not limited thereto and that it can be variously practiced within the scope of the following claims.

I claim:

1. A railway coupler carrier assembly of the type having a spring basket defined by front and rear walls, two substantially opposing end walls and a bottom wall, said spring basket acting as a carrier pocket with a plurality of compression springs disposed therein; and a coupler carrier having an upper substantially horizontal plate portion for supporting a coupler, and a lower portion at least partially disposed in said spring basket, said coupler carrier being supported on said compression springs for vertical movement in said basket; a wear element including a front wall, a rear wall and a bottom wall and located so that said front, rear and bottom walls of said wear element are adjacent to at least a portion of said front, rear and bottom walls of said spring basket, respectively, said wear element acting to reduce contact between said spring basket and said coupler carrier as said spring basket and said coupler carrier move in relation to each other, said lower portion of said coupler carrier including two substantially opposing, laterally extending lugs each of which cooperate with a different end wall of said spring basket to restrain the movement of said spring basket relative to said coupler carrier, said wear element further including two lateral extensions each of which engage a different lug, said extensions being formed by two projections from said front wall of said wear element in engaging relationship with two projections from said rear wall of said wear element.

2. A railway coupler carrier assembly of the type having a spring basket defined by front and rear walls, two substantially opposing end walls and a bottom wall, said spring basket acting as a carrier pocket with a plurality of compression springs disposed therein; and a coupler carrier having an upper substantially horizontal plate portion for supporting a coupler, and a lower portion at least partially disposed in said spring basket, said coupler carrier being supported on said compression springs for vertical movement in said basket; a wear element including a front wall, a rear wall and a bottom wall and located so that said front, rear and bottom walls of said wear element are adjacent to at least a portion of said front, rear and bottom walls of said spring basket, respectively, each of said compression springs having a bottom end which contacts said bottom wall of said wear element, and wherein said bottom wall of said spring basket has a plurality of bottom bosses located thereon, each of said compression springs being positioned on one of said bottom bosses, and said bottom wall of said wear element having a plurality of holes therein to allow said bottom bosses to protrude therethrough, said wear element acting to reduce contact between said spring basket and said coupler carrier as said spring basket and said coupler carrier move in relation to each other.

* * * * *